US005095881A

United States Patent [19]

Nishimura et al.

[11] Patent Number: 5,095,881

[45] Date of Patent: Mar. 17, 1992

[54] CYLINDER INJECTION TYPE INTERNAL COMBUSTION ENGINE

[75] Inventors: Seiichi Nishimura; Osamu Salamoto, both of Hamamatsu, Japan

[73] Assignee: Sanshin Kogyo Kabushiki Kaisha, Hamamatsu, Japan

[21] Appl. No.: 598,991

[22] Filed: Oct. 17, 1990

[30] Foreign Application Priority Data

Oct. 17, 1989 [JP] Japan ..... 1-269744

[51] Int. Cl.[5] ..... F02M 23/12

[52] U.S. Cl. ..... 123/532; 183/316

[58] Field of Search ..... 123/531, 532, 533, 534; 239/585

[56] References Cited

U.S. PATENT DOCUMENTS

| | | | |
|---|---|---|---|
| 4,210,105 | 7/1980 | Nohira et al. | 123/316 |
| 4,406,260 | 9/1983 | Burley | 123/316 |
| 4,628,888 | 12/1986 | Duret | 123/533 |
| 4,765,304 | 8/1988 | Brown | 123/532 |
| 4,771,754 | 9/1988 | Reinke | 123/532 |
| 4,865,002 | 9/1989 | Borst et al. | 123/532 |
| 4,934,346 | 6/1990 | Olson | 123/532 |
| 4,936,279 | 6/1990 | Ragg | 123/533 |
| 4,944,277 | 7/1990 | Olson | 123/532 |

*Primary Examiner*—E. Rollins Cross

*Attorney, Agent, or Firm*—Ernest A. Beutler

[57] ABSTRACT

A fuel air injection system for a two cycle crankcase compression internal combustion engine wherein a pressure accumulator is provided in the injector and the accumulator is charged with a compressed charge from the combustion chamber into which the injector injects during a phase of operation. In one embodiment of the invention, the accumulator chamber is charged during a compression stroke when ignition does not occur and in another embodiment of the invention, the accumulator chamber is charged during the same stroke of the engine when ignition occurs.

25 Claims, 8 Drawing Sheets

CYLINDER INJECTION TYPE INTERNAL COMBUSTION ENGINE

BACKGROUND OF THE INVENTION

This invention relates to a cylinder injection type internal combustion engine and more particularly to an injection system that injects fuel and pressurized air into the combustion chamber and to a method of operating an engine employing such a fuel air injector.

The advantages of direct cylinder fuel injection are well known. It has been proposed to improve the performance of a two cycle internal combustion engine by direct cylinder fuel injection. In order to improve atomization of the fuel and reduce hydrocarbon emissions, compressed air is added to the cylinder along with the injected fuel.

In systems that employ both fuel and compressed air injection, however, the engine tends to become quite complicated. That is, in addition to the normal fuel injection system, there must be provided a source of compressed air. This generally requires the use of an air compressor, pressure regulator and air distribution line. Such complication of the engine is, of course, undesirable.

It has been further proposed to employ as a pressurized gas source, a portion of the compressed gases that had been ignited in another cylinder of the engine. That is, one cylinder which is burning and undergoing the expansion and scavenge cycle has a portion of the expanding gases charged into an accumulator which is utilized to inject fuel into another cylinder of the engine at the time of fuel injection. Although such arrangements provide some simplification in that they do not require an air compressor, the conduitry required to communicate various cylinders with each other does provide some complications. Furthermore, the compressed charge which is employed is formed of both fuel and air and which have been at least partially burned. As a result, the charge is at a high temperature and also may include foreign particles, such as carbon or the like, which can give rise to obvious problems.

It is, therefore, a principal object of this invention to provide an air fuel injection system for an engine in which a separate source of compressed air is not required and in which the air which is employed for fuel injection is compressed within the same combustion chamber of the engine but which does not contain any substantial amount of combustion products.

It is a further object of the invention to provide an improved injector of this type which can be utilized with a two cycle internal combustion engine.

It is a further object of this invention to provide a fuel air injector for an internal combustion engine and method of operating an engine wherein the compressed air for the fuel injector is supplied to the injector directly from the cylinder of the engine into which it injects.

SUMMARY OF THE INVENTION

A first feature of this invention is adapted to be embodied in an injection system for an internal combustion engine having a combustion chamber. Means are provided for compressing a charge in the combustion chamber and a pressure accumulator is pressurized by the charge compressed within the combustion chamber during at least a portion of the cycle of operation of the engine. An injector is provided for injecting a compressed air charge and a fuel charge directly into the combustion chamber. Means are provided for delivering fuel to the injector. Means are also provided for delivering the compressed charge from the pressure accumulator to the injector for injection into the combustion chamber.

Another feature of the invention is adapted to be embodied in a method of operating a fuel air injector having a pressure accumulator chamber, a chamber into which fuel is injected, and a single injection valve that controls communication of the accumulator chamber and the fuel injection chamber with the combustion chamber of the engine. In accordance with the invention, the injector valve is opened during a cycle of operation of the combustion chamber to permit a compressed charge within the combustion chamber to enter the accumulator chamber. The injector valve is then opened at another time and fuel is injected so that the compressed charge and the fuel will be delivered to the combustion chamber.

Yet another feature of the invention is adapted to be embodied in the operation of a two cycle crankcase compression internal combustion engine having an injector that injects directly into the combustion chamber through an injection valve when the injection valve is opened. In addition, an ignition means is provided for initiating ignition in the combustion chamber. In accordance with this feature of the invention, the injector valve is opened at a time when the ignition means is not operated so as to permit a compressed charge to flow from the combustion chamber into the injector. The injector valve is then opened at another time to permit a charge to enter the combustion chamber and the ignition means is fired after the injector valve has been opened and the charge has entered the combustion chamber.

DETAILED DESCRIPTION OF THE PREFERRED EMBODIMENTS

Figure 1:
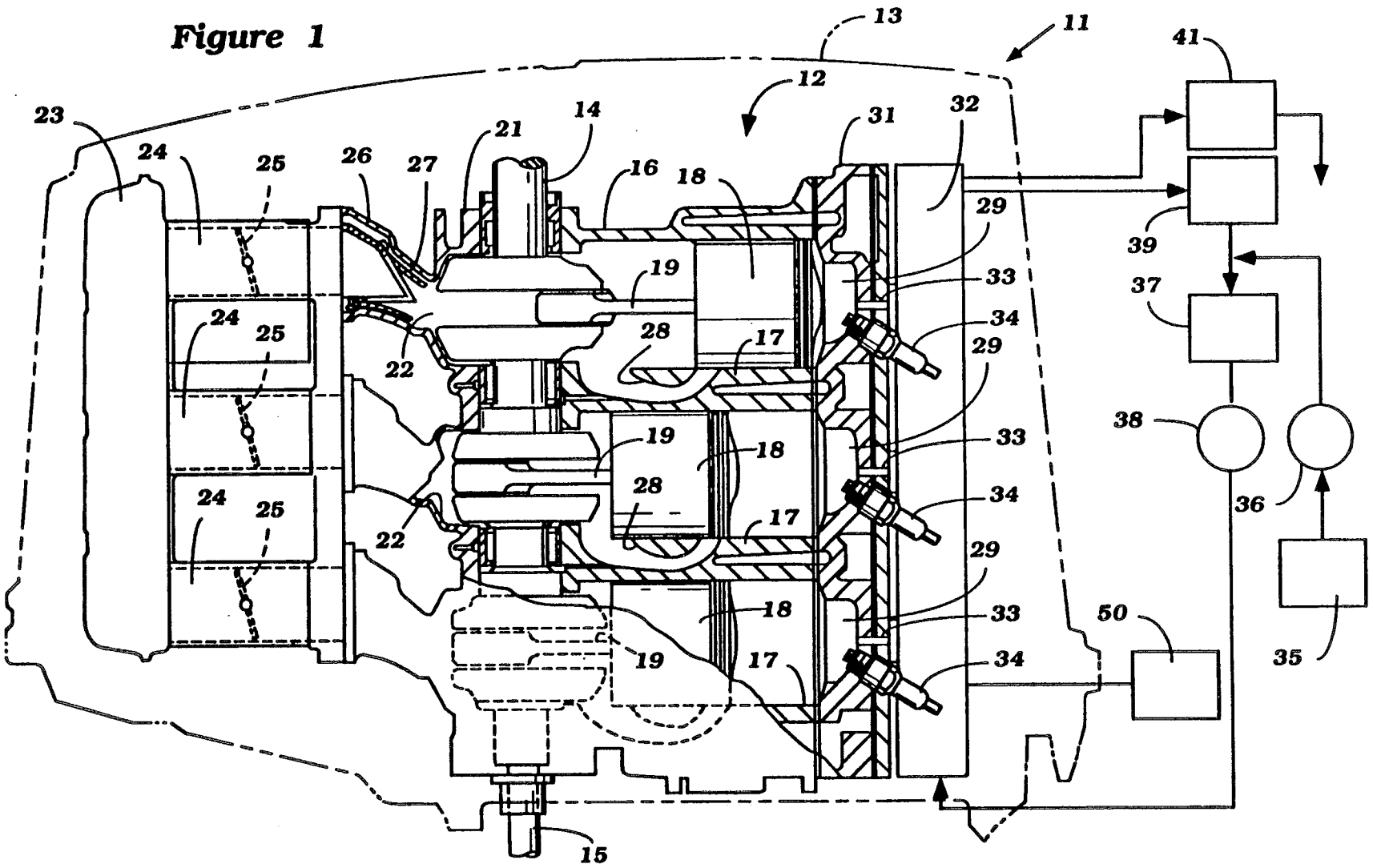
FIG. 1 is a side elevational view of the power head of an outboard motor having an internal combustion engine provided with a fuel injection system and operating in accordance with a method embodying the invention, with portions broken away and other portions shown schematically.

Referring first initially to FIG. 1, an outboard motor constructed in accordance with an embodiment of the invention is identified generally by the reference numeral 11 and is shown partially and with portions shown in phantom. The invention is described in conjunction with an outboard motor inasmuch as the invention has particular utility in connection with such applications. This is because the invention has particular utility with two cycle crankcase compression engines and such engines are normally employed as the power source for outboard motors. It is to be understood, of course, that the invention may be employed with other applications for internal combustion engines and with other engines than those operating on the two stroke crankcase compression principle. However, the invention has particular utility in conjunction with such engines.

The engine, identified generally by the reference numeral 12, is surrounded by a protective cowling, as is conventional in outboard motor practice. This cowling is shown in phantom and is identified generally by the reference numeral 13. As is conventional with outboard motor practice, the engine output shaft, a crankshaft 14, is supported for rotation about a vertically extending axis. The crankshaft 14 is connected to a drive shaft 15 which depends through a drive shaft housing (not shown) and drives a propulsion unit of the lower unit of the outboard motor 11.

The engine 12 is comprised of a cylinder block 16 that is formed with three horizontally extending cylinder bores 17 and in which pistons 18 are slidably supported. The pistons 18 are connected by means of connecting rods 19 to the individual throws of the crankshaft 14 for driving it in a well known manner. The crankshaft 14 is journaled within a crankcase chamber formed by the cylinder block 16 and a crankcase member 21 that is affixed to the cylinder block 16 in a known manner. As is conventional with two cycle crankcase compression engines, the crankcase is divided into three sealed chambers 22, each of which is isolated from the others through a suitable sealing system.

An air charge is delivered to the crankcase chambers 22 from an air inlet device 23 which draws air from within the protective cowling 13 and which silences it. The inlet device 23 communicates with: a plurality of throttle bodies 24 in which throttle valves 25 are provided for speed control. The throttle bodies 24 communicate with respective branches of a manifold 26 in which reed type check valves 27 are provided so as to deliver the air charge to the individual crankcase chambers 22. The reed type valves 27 preclude reverse flow of the compressed air from within the crankcase chambers 22 back to the throttle bodies 24 at such times as the pistons 18 are descending and compressing this charge in the crankcase chambers 22.

When the air charge is compressed within the crankcase chambers 22, it is: then delivered through scavenge passages 28 formed in the cylinder block 16 to combustion chambers 29 that are formed above the cylinder bores 17 by the heads of the pistons 18 and a cylinder head assembly 31 that is affixed to the cylinder block 16 in a known manner.

A fuel air charge is also delivered to the combustion chambers 29 at an appropriate time by injectors 32 which have nozzle portions 33 that extend through the cylinder head 31 into the combustion chambers 29. The construction of the injectors 32 will be described later by particular reference to FIGS. 2 through 4.

The charge is then fired by spark plugs 34 which are also mounted in the cylinder head 31 and extend into the combustion chambers 29. The spark plugs 34 are fired by an appropriate ignition system at the proper timing. The burnt charge is then exhausted through exhaust ports (not shown) formed in the cylinder block 16 and discharged to the atmosphere through a suitable exhaust system. In the case of an outboard motor application, this exhaust system may include an underwater high speed exhaust discharge.

As has been previously noted, the injectors 32 inject a fuel air charge into the combustion chambers 19. The fuel for this charge is supplied from a remotely positioned fuel tank shown schematically at 35 in FIG. 1 from which fuel is drawn by a fuel pump 36. The fuel pump 36 outputs the fuel to a water separator 37 and further fuel pump 38. The fuel is then delivered to injector nozzles (to be described) of the injectors 32.

The fuel pressure is regulated by a regulator 39 in a suitable manner such as bypassing excess fuel back to the water separator 37. In addition, an air pressure regulator 41 cooperates with the injectors 32 for regulating the air pressure so as to maintain the desired relationship between air and fuel pressure and the appropriate amounts of air and fuel injected.

Figure 2:
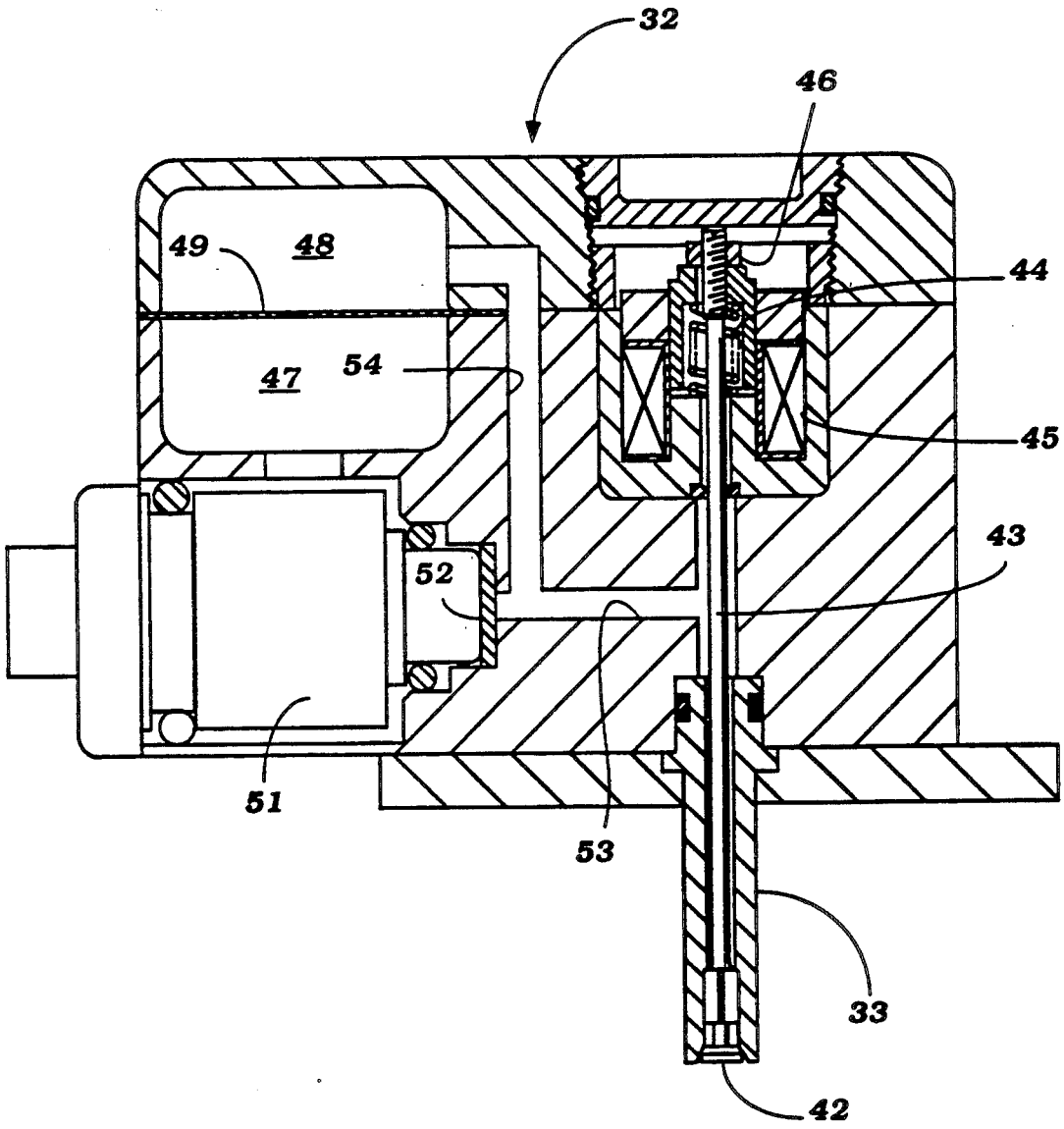
FIG. 2 is an enlarged cross sectional view taken through one of the injector units.
Figure 3:
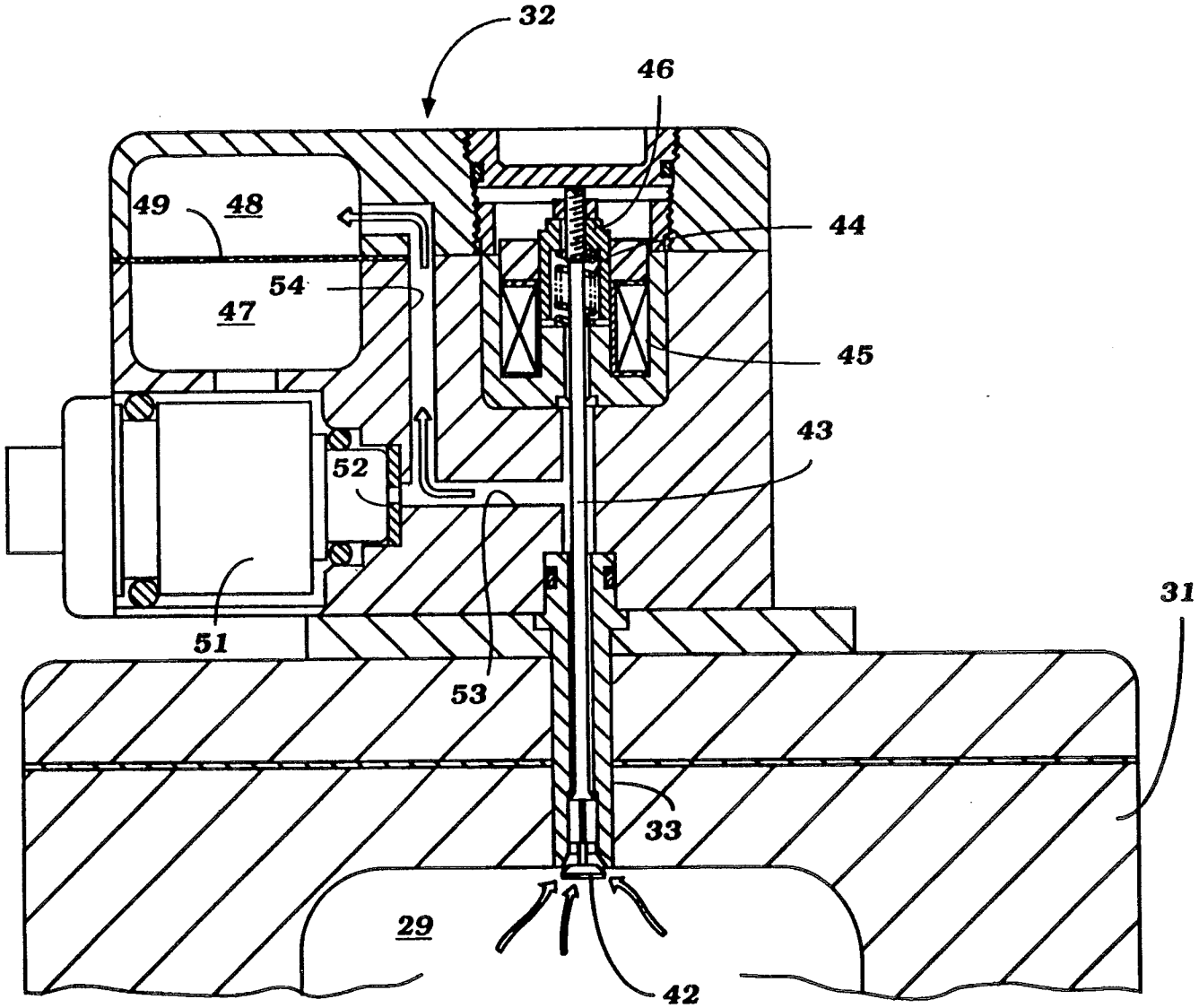
FIG. 3 is a cross sectional view taken through one of the injector units and showing its mounting in the engine and the charging operation.
Figure 4:
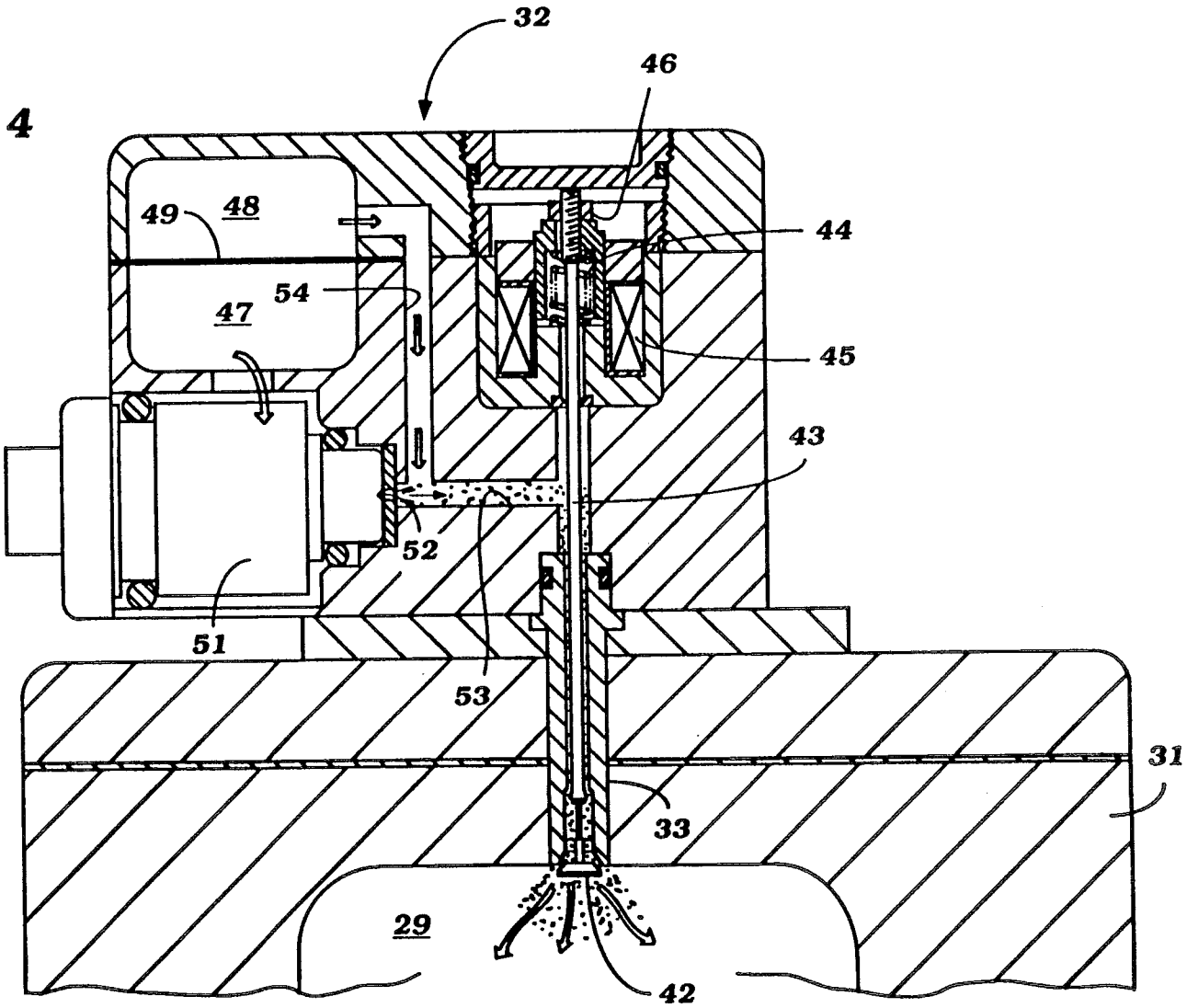
FIG. 4 is a cross sectional view, in part similar to FIG. 3, showing the injection mode.

Referring now in detail to FIGS. 2 through 4, the injector unit 32 will be described. As previously noted, these injector units 32 have nozzle portions 33 that extend through the cylinder head 31 and communicate with the combustion chambers 29. An injection control valve 42 is provided at the tip of the nozzle portions 33 for controlling the communication of the injectors 32 with the combustion chambers 29 in accordance with a sequence to be described. The injector valves 42 have stem portions 43 and are normally urged to a closed position by means of a coil spring assembly 44. A solenoid winding 45 encircles the valve stem 43 and cooperates with an armature 46 that is threaded onto the valve stem 43 for urging the valve 42 to its open position when the winding 45 is energized. The connection of the armature 46 to the valve stem 43 also permits adjustment of the preload of the springs 44.

The injectors 32 are provided with a fuel chamber 47 and an air pressure chamber or accumulator 48 that are separated from each other by means of a flexible diaphragm 49 that is clamped between a pair of pieces of the housing of the injector 32. The fuel chamber 47 receives fuel from the pump 38 at a regulated pressure, as aforenoted, and supplies this fuel to a fuel injector 51. The fuel injector 51 and solenoid winding 46 are controlled by means of a controller 50 (FIG. 1) in accordance with a sequence to be described. The fuel injector 51 injects fuel through a nozzle 52 into a chamber 53 formed within the injector housing and which communicates with the nozzle 33.

The accumulator 48 communicates with the chamber 53 through a passageway 54 and, accordingly, with the nozzle 33. The controller 50 operates generally such that the injector valve 42 is opened by energizing the solenoid 45 at a time when the volume of the combustion chamber 29 is being diminished so as to increase the pressure therein. This permits the pressurized charge to enter the accumulator chamber 48 and be stored under pressure. The injector valve 42 is then closed and is reopened at a time when the chambers 29 are to be charged with a fuel air charge. At this same time, the fuel injectors 51 are actuated by the controller 50 so that a fuel air charge will issue into the combustion chambers 29 with the air charge being provided by the previously accumulated pressure within the accumulator 48.

In normal two cycle engine practice, the spark plugs 34 are fired with each revolution of the crankshaft 14 at some time before top dead center condition. However, in accordance with this embodiment of the invention, the spark plugs 34 are fired only every other revolution and during alternate revolutions, the injection valve 42 is opened so as to pressurized the accumulator chamber 48. This not only permits better scavenging but permits the accumulation of a substantially pure air charge in the accumulator chamber 48.

Figure 5:
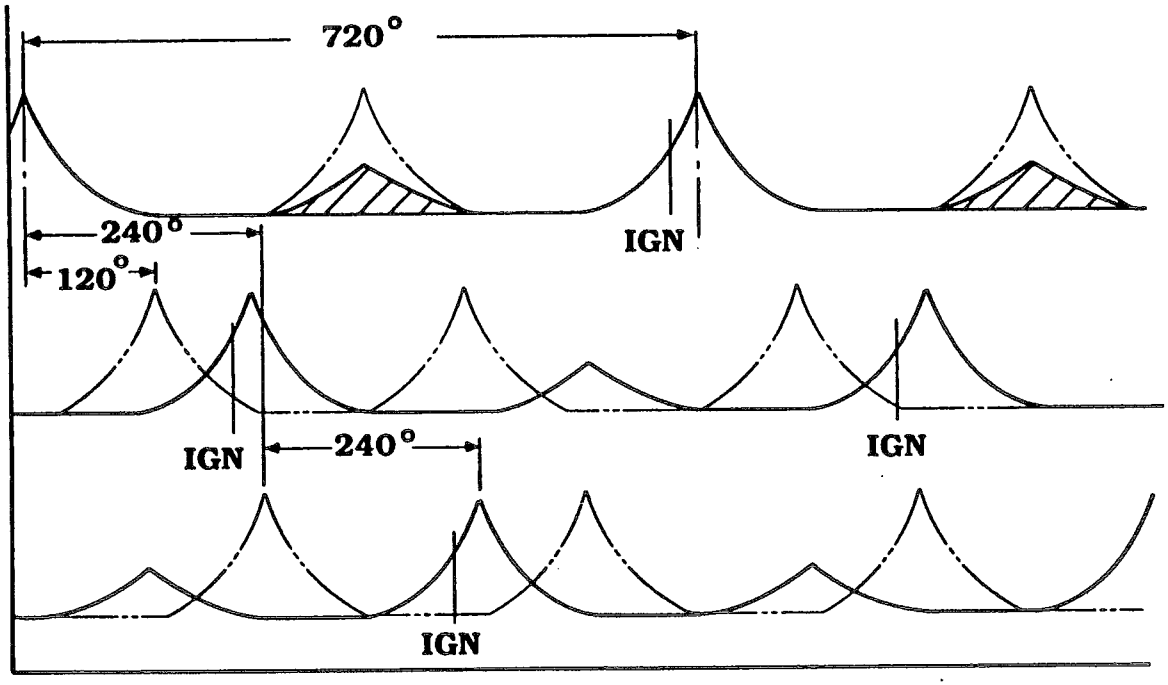
FIG. 5 is a graphic view showing the pressure traces within the chambers of the engine.

FIG. 5 illustrates the pressure traces in the individual cylinders. As may be seen by the solid line view, the pressure rises to a peak and then falls off. The point of ignition of the spark plug is indicated by the point ign which occurs sometime before top dead center. On alternate cycles, as shown by the shaded line area, the pressure does not rise as high as when ignition occurs every cycle, as shown by the dot dash line, and rather than firing taking place every 360° of crankshaft revolution, it will take place every 720°. This means that the firing impulses between the individual cylinders occurs not at the normal 120° interval, but at a 240° interval.

Figure 6:
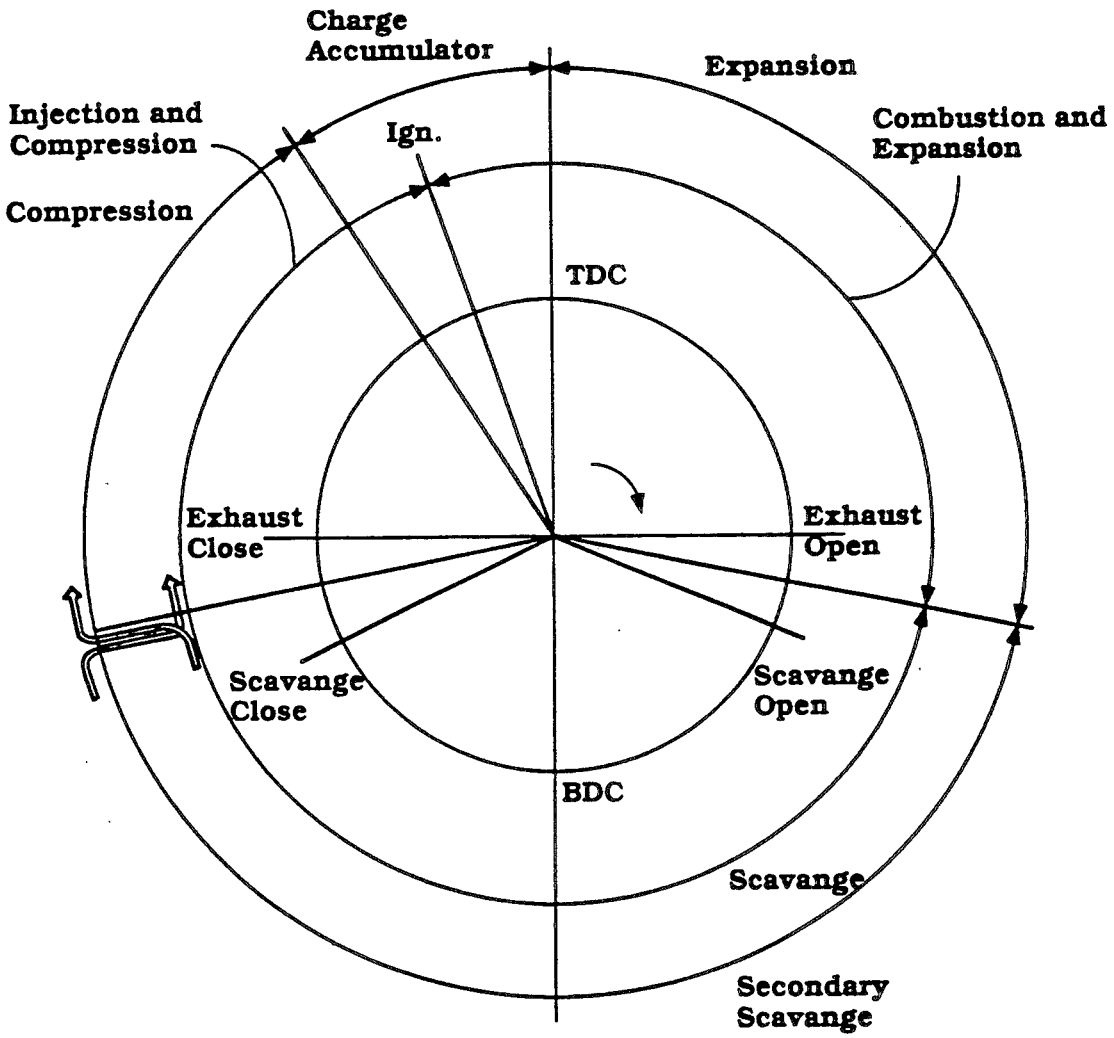
FIG. 6 is a timing diagram showing one method of operation in accordance with the invention.

The sequence of operation of this embodiment may be best understood by reference to FIG. 6 wherein the timing cycle for two revolutions of the crankshaft are illustrated. Considering the first revolution as indicated by the inner circle, ignition (ign) occurs before top dead center and the fuel air charge which has been previously injected into the combustion chamber will then burn, expand and drive the piston 18 downward. At some point after top dead center, the exhaust port will open, as indicated by the line. Subsequently the intake port will also open, as indicated therein. The scavenging continues up until the point when the intake or scavenge port closes and then the cycle moves to the outer circle as shown in the figure at the time when the exhaust port closes and compression will then occur of the charge within the combustion chamber 29 due to the ascent of the piston. At some point before top dead center, the controller 50 will actuate the solenoid 45 so as to open the injection valve 42 and permit the compressed charge to flow through the chamber 53 and passageway 54 to charge the accumulator 48. This continues for a time period at which time the injection valve 42 is again closed and the piston will move downward after top dead center until the exhaust port again opens so as to further improve the scavenging. This operation then continues and the intake port opens. The intake or scavenge port will then subsequently close and the exhaust port will close. At some point during this time period, the solenoid 45 will again be actuated so as open the injection valve 42. Fuel injection from the injector 51 will commence and the fuel will be atomized by the escaping pressurized air charge from the reservoir 48 as shown in FIG. 4 and a fuel air charge delivered to the chamber 29. The injection valve 42 is then closed at some point before top dead center and before ignition occurs wherein the cycle will repeat as aforedescribed.

Figure 7:
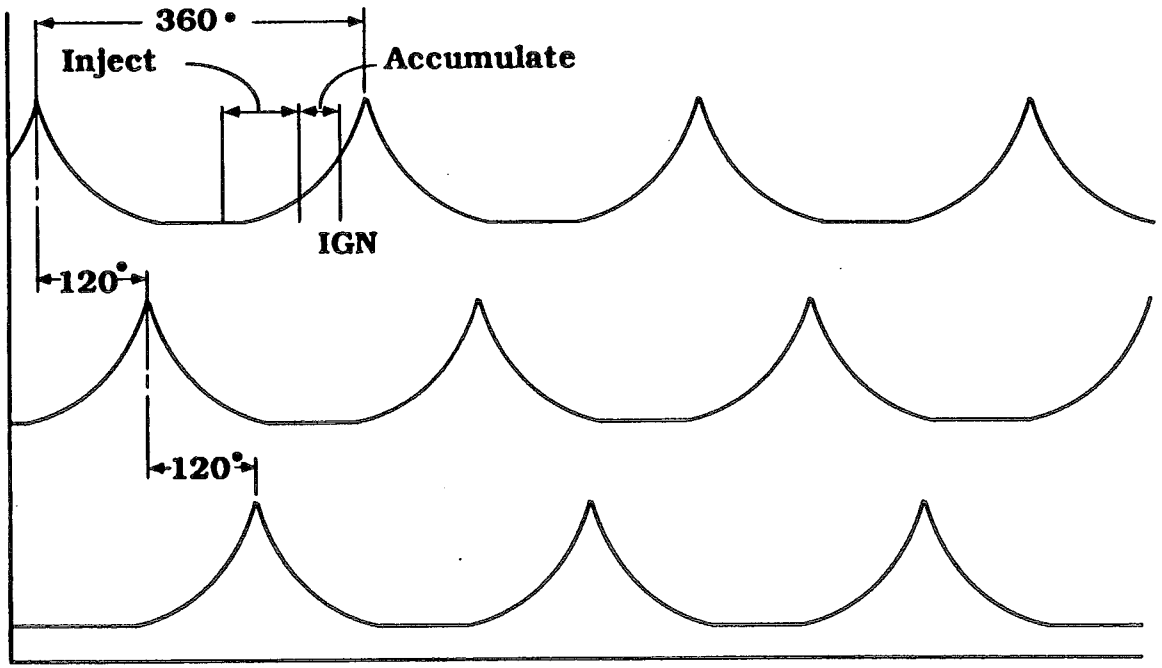
FIG. 7 is a pressure trace, in part similar to FIG. 5, showing another embodiment of the invention.
Figure 8:
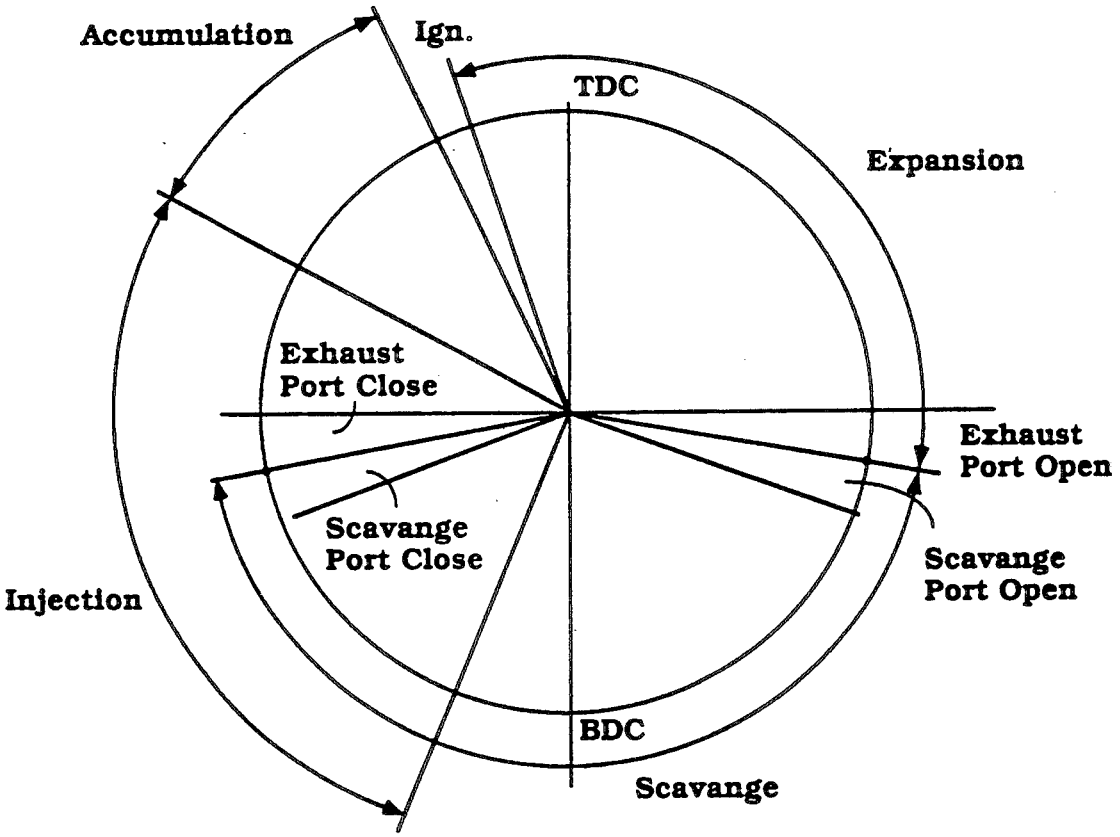
FIG. 8 is a timing diagram of this embodiment.

In the embodiment as thus far described, the spark plug was only fired every other revolution of the crankshaft and the accumulator chamber 48 was charged during alternate cycles. Of course, it is possible to achieve the same type of effect by firing during every crankshaft revolution and FIGS. 7 and 8 show such an embodiment. Basically in this embodiment, the fuel injector is operated so that the valve 42 is opened and fuel and pressurized air are injected into the combustion chamber during the scavenging stroke and then the injection nozzle is closed. The injection nozzle is then opened again so as to permit a portion of the charge being compressed in the combustion chamber to be delivered back into the accumulator chamber 48 and the injection valve 42 is again closed. Ignition is then accomplished. Since the structure for achieving this result is the same as that of the preceding embodiment, further illustration of this mechanism is not required. All that is required is reference to the pressure trace of FIG. 7 and the timing diagram of FIG. 8, it being understood that the construction is the same as that previously described.

Referring to these two figures, ignition occurs at some point prior to top dead center and once ignition has occurred, the pressure will rise in the combustion chamber to a peak and the pistons 18 will be driven downward. Eventually, a point will be reached when the exhaust port is opened and subsequently the intake port will open and scavenging will begin.

Some time after bottom dead center, the injector valve 42 is opened and fuel and a pressurized air charge will enter the combustion chamber. This continues through the time when the intake port closes and the exhaust port closes. The injection valve 42 will then be closed and will then subsequently be reopened so as to permit an accumulator charge to be built up in the accumulator chamber 48. The valve 42 is then again closed before ignition occurs. Hence, ignition will occur every 360° of crankshaft rotation, and with a three cylinder engine, firing impulses will take place every 120° of crankshaft revolution.

In the embodiment of FIGS. 7 and 8, it has been described that the valve 42 opens and closes twice each cycle. The valve 42 can be maintained in an open position and fuel injection merely stop during a portion of the opening. In this way, the opening and closing twice will be eliminated, but the accumulator chamber still can be charged.

It should be readily apparent from the foregoing description that the described embodiments of the invention are very effective in permitting the use of air fuel injection without requiring separate air compressors and without having the necessity of charging the accumulator for one chamber from another chamber with gases that can include combustion products. Also, in one embodiment of the invention, scavenging is improved by firing of the spark plug only every other crankshaft revolution. Of course, the described constructions are only preferred embodiments of the invention. Various changes and modifications may be made without departing from the spirit and scope of the invention, as defined by the appended claims.

We claim:

1. An injection system for an internal combustion engine having a combustion chamber, means for compressing a charge in said combustion chamber, a pressure accumulator pressurized by the charge compressed within said combustion chamber during at least a portion of a cycle of operation of said engine, an injector for injecting a compressed air charge and a fuel charge directly into said combustion chamber, means for delivering furl to said injector for injection thereby, means for delivering the compressed charge from said pressure accumulator to said injector for injecting thereby and control means for effecting the delivery of fuel to said injector only after said injector begins to deliver an air charge to said combustion chamber.

2. An injection system as set forth in claim 1 wherein the pressure accumulator is formed within the injector.

3. An injection system as set forth in claim 2 wherein the injector is provided with an injection valve which controls the flow of fuel and compressed charge to the combustion chamber and wherein the pressure accumulator is charged by opening of said injection valve.

4. An injection system for an internal combustion engine having a combustion chamber, means for compressing a charge in said combustion chamber, a pressure accumulator formed within said injector and pressurized by the charge compressed within said combustion chamber during at least a portion of a cycle of operation of said engine, means for delivering fuel to said injector for injection thereby, means for delivering the compressed charge from said pressure accumulator to said injector for injecting thereby, said injector being provided with an injection valve which controls the flow of fuel and compressed charge to said combustion chamber and wherein said pressure accumulator is charged by opening of said injection valve, said engine being a two cycle crankcase compression engine and said engine is fired on alternate revolution with said pressure accumulator being charged on the revolutions when the charge is not ignited.

5. An injection system for in internal combustion engine having a combustion chamber, means for compressing a charge in said combustion chamber, a pressure accumulator formed within said injector and pressurized by the charge compressed within said combustion chamber during at least a portion of a cycle of operation of said engine, means for delivering fuel to said injector for injection thereby, means for delivering the compressed charge from said pressure accumulator to said injector for injecting thereby, said injector being provided with an injection valve which controls the flow of fuel and compressed charge to said combustion chamber and wherein said pressure accumulator is charged by opening of a said injection valve, said engine being a two cycle crankcase compression engine and said pressure accumulator when the fuel air injection takes place and after the fuel air injection.

6. An injection system as set forth in claim 1 wherein the compressed charge is directly charged into the pressure accumulator.

7. An injection system as set forth in claim 6 wherein the pressure accumulator is formed within the injector.

8. An injection system for an internal combustion engine having a combustion chamber, means for compressing a charge in said combustion chamber, a pressure accumulator formed within said injector and pressurized by the charge compressed within said combustion chamber during at least a portion of a cycle of operation of said engine, means for delivering fuel to said injector for injecting thereby, and means for delivering the compressed charged from said pressure accumulator to said injector for injecting thereby, said engine being fired on alternative revolution with said pressure accumulator being charged on the revolutions when the charge is not ignited.

9. An injection system as set forth in claim 8 wherein the engine operates on the two cycle crankcase compression principle.

10. An injection system as set forth in claim 7 wherein the pressure accumulator is charged during a portion of the same cycle when the fuel air injection takes place and after the fuel air injection.

11. An injection system as set forth in claim 10 wherein the engine operates on the two cycle crankcase compression principle.

12. A method of operating a fuel injected internal combustion engine comprising a an injector having a pressure accumulator portion and a fuel injector and an injection valve for controlling the communication of the fuel injector and the accumulator portion with a combustion chamber of the engine comprising the steps of opening the injection valve at a time when fuel has not been injected into the injector by the fuel injector for charging the accumulator with a compressed charge, closing the injection valve, and reopening the injection valve at a time when fuel is injected by the fuel injector so that the injected fuel will be atomized by the pressurized charge in the accumulator.

13. A method as set forth in claim 12 wherein the injection valve is opened and closed during the same cycle of operation for injecting fuel and charging the accumulator chamber.

14. A method as set forth in claim 13 wherein the associated engine is a crankcase compression two cycle engine and the injector injects directly into the combustion chamber of the engine.

15. A method as set forth in claim 12 wherein the injector valve is opened to charge the accumulator chamber during one cycle of operation of the engine and the injection valve is open to inject fuel and pressurized charge during another cycle of the engine.

16. A method as set forth in claim 15 wherein the engine is a crankcase compression two cycle engine and the accumulator chamber is charged during a cycle when ignition does not occur and the fuel and compressed charge is discharged at a cycle when ignition does occur.

17. A method of operating a two cycle crankcase compression internal combustion engine having direct cylinder injection from an injector having a pressure accumulator chamber and a fuel injector and an injection valve that controls the communication of the fuel injector and the pressure accumulator with the combustion chamber of the engine comprising the steps of compressing the charge within the combustion chamber without firing of the charge during that compression cycle and opening the injection valve for pressurizing the accumulator chamber and closing the injection valve during that cycle of operation, opening the injection valve during another cycle of compression and injecting fuel for atomizing the injected fuel by the pressure in the accumulator and firing the charge in the combustion chamber during that cycle of operation.

18. An injection system as set forth in claim 3 wherein the engine is a two cycle crankcase compression engine and the engine is fired on alternative revolutions with the pressure accumulator being charged on the revolutions when the charge is not ignited.

19. An injection system as set forth in claim 3 wherein the engine is a two cycle crankcase compression engine and the pressure accumulator is charged during a portion of the same cycle when the fuel air injection takes place and after the fuel air injection.

20. An injection system as set forth in claim 1 wherein the compressed charge is directly charged into the pressure accumulator.

21. An injection system as set forth in claim 20 wherein the pressure accumulator is formed within the injector.

22. An injection system as set forth in claim 21 wherein the engine is fired on alternate revolutions with the pressure accumulator being charged on the revolutions when the charge is not ignited.

23. An injection system as set forth in claim 22 wherein the engine operates on the two cycle crankcase compression principle.

24. An injection system as set forth in claim 21 wherein the pressure accumulator is charged during a portion of the same cycle when the fuel air injection takes place and after the fuel air injection.

25. An injection system as set forth in claim 24 wherein the engine operates on the two cycle crankcase compression principle.

* * * * *

UNITED STATES PATENT AND TRADEMARK OFFICE

CERTIFICATE OF CORRECTION

PATENT NO. : 5,095,881

DATED : March 17, 1992

INVENTOR(S) : Nishimura, et al

It is certified that error appears in the above-identified patent and that said Letters Patent is hereby corrected as shown below:

On the title page, under "Inventors", "Salamoto" should be --Sakamoto--.

Column 6, line 59, Claim 1, "furl" should be --fuel--.

Column 7, line 19, Claim 4, "revolution" should be --revolutions--.

Column 7, line 37, Claim 5, after "accumulator" insert --is charged during a portion of the same cycle--.

Column 7, line 52, Claim 8, "charged" should be --charge--.

Column 7, line 54, Claim 8, "revolution" should be --revolutions--.

Column 7, line 68, Claim 12, delete "a".

Signed and Sealed this

Twenty-third Day of November, 1993

*Attest:*

Bruce Lehman

BRUCE LEHMAN

*Attesting Officer*

*Commissioner of Patents and Trademarks*